US005610644A

United States Patent [19]

Timm, Jr. et al.

[11] Patent Number: 5,610,644

[45] Date of Patent: *Mar. 11, 1997

[54] THERMAL INK-JET PEN WITH A PLASTIC/METAL ATTACHMENT FOR THE COVER

[75] Inventors: Dale D. Timm, Jr., Solana Beach; David W. Swanson, Escondido, both of Calif.; James E. Clark, Albany, Oreg.

[73] Assignee: Hewlett-Packard Company, Palo Alto, Calif.

[ * ] Notice: The term of this patent shall not extend beyond the expiration date of Pat. No. 5,451,995.

[21] Appl. No.: 994,810

[22] Filed: Dec. 22, 1992

[51] Int. Cl.[6] ..... B41J 2/175

[52] U.S. Cl. ..... 347/87; 29/890.1; 29/453

[58] Field of Search ..... 346/1.1, 140 R; 29/453, 890.01; 220/4.01, 307, 306; 347/86, 87; B41J 2/175

[56] References Cited

U.S. PATENT DOCUMENTS

| | | | |
|---|---|---|---|
| 3,913,774 | 10/1975 | Vajtay | 220/4.01 |
| 4,616,764 | 10/1986 | Utoh et al. | 220/307 X |
| 4,739,339 | 4/1988 | De Young et al. | 347/86 |
| 4,931,811 | 6/1990 | Cowger et al. | 346/140 R |
| 5,451,995 | 9/1995 | Swanson et al. | 347/87 |
| 5,464,578 | 11/1995 | Salter et al. | 347/87 X |

*Primary Examiner*—Alrick Bobb

[57] ABSTRACT

A thermal ink-jet (TIJ) pen including a plastic frame structure and side covers. To attach the covers to the plastic frame without the use of adhesives, screws, thermal or ultrasonic processes, protruding metal tabs from the cover are press fit into corresponding recess features of the plastic frame. The tabs are designed to displace plastic surrounding the frame recesses to lock the cover to the frame. The resulting frame/cover seam resists shear, axial and transverse forces that occur as a result of externally applied loads to the pen.

41 Claims, 6 Drawing Sheets

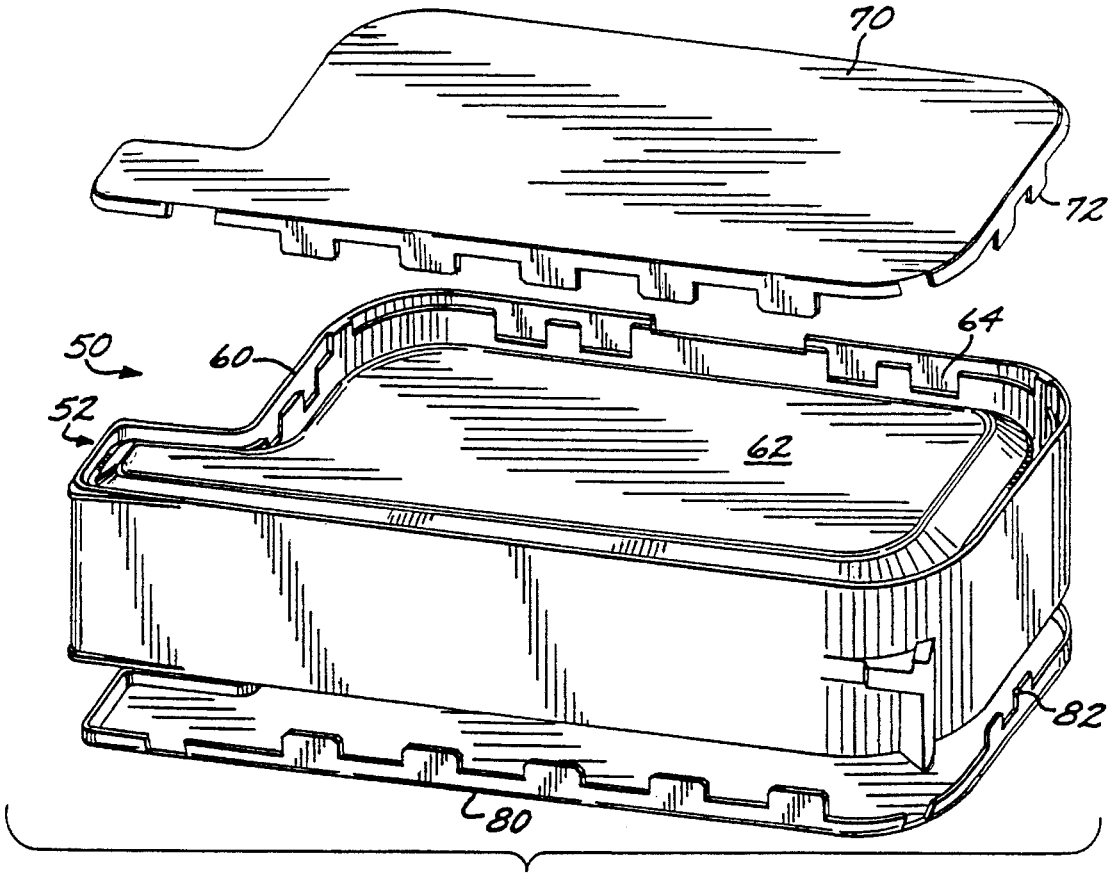
FIG. 1
FIG. 2
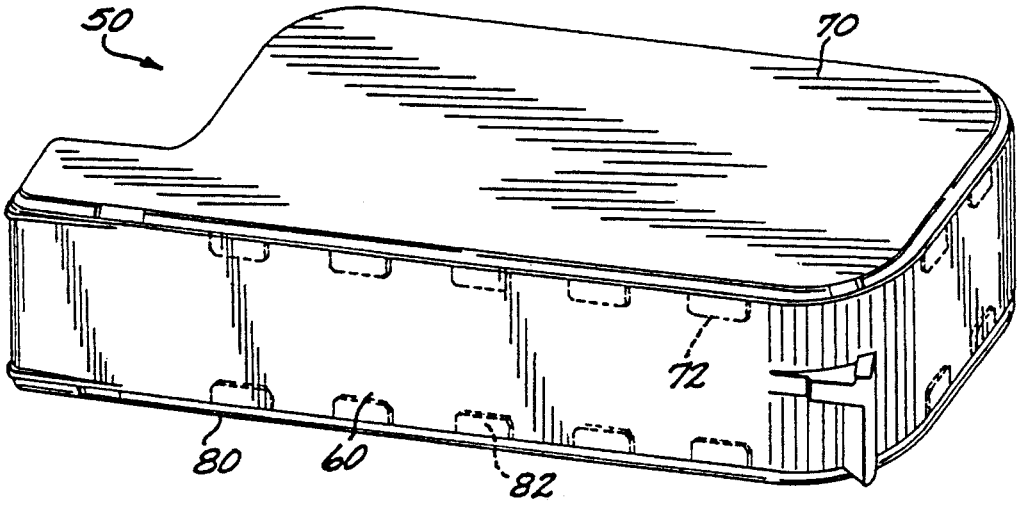

FIG. 5
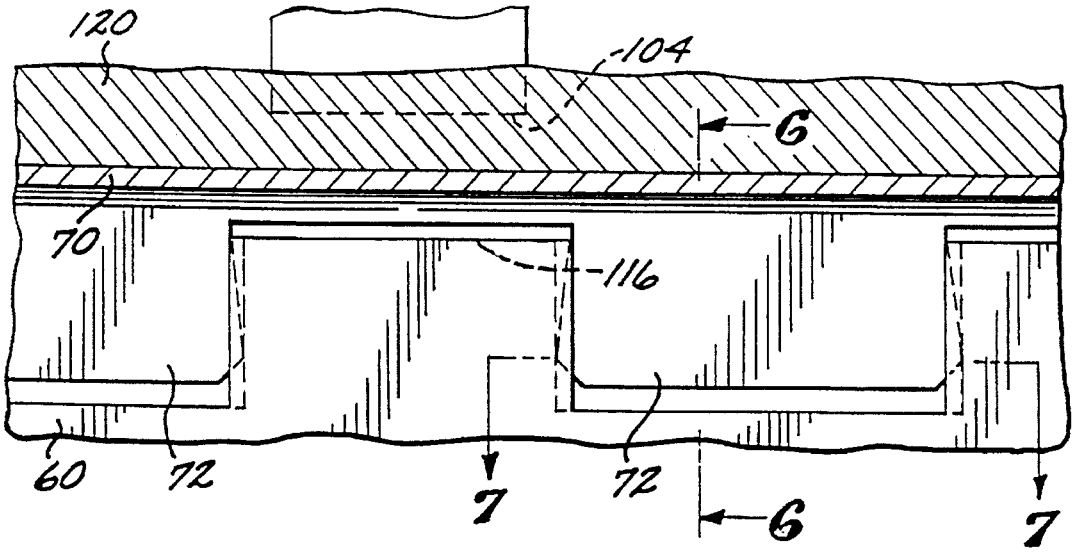
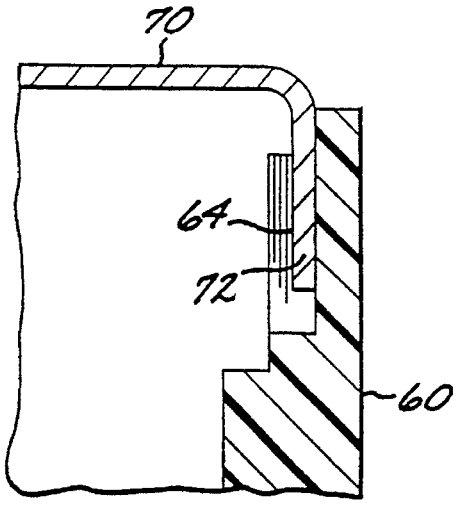
FIG. 6
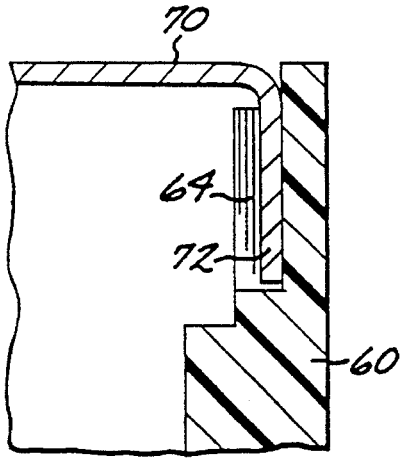
FIG. 6A
FIG. 7
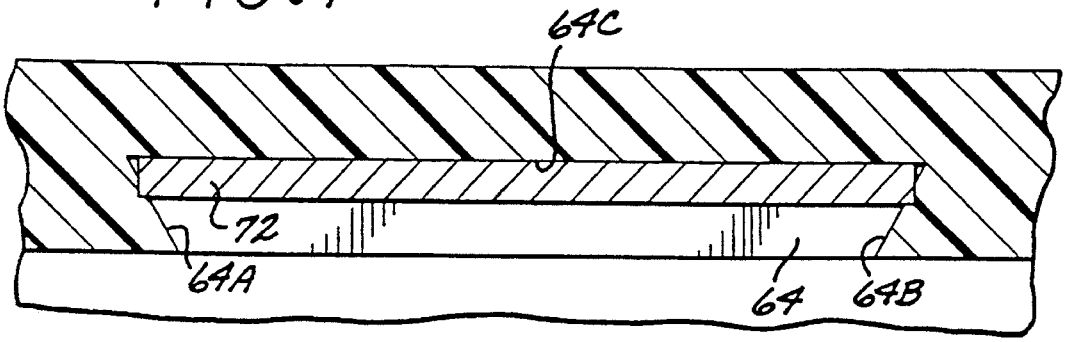

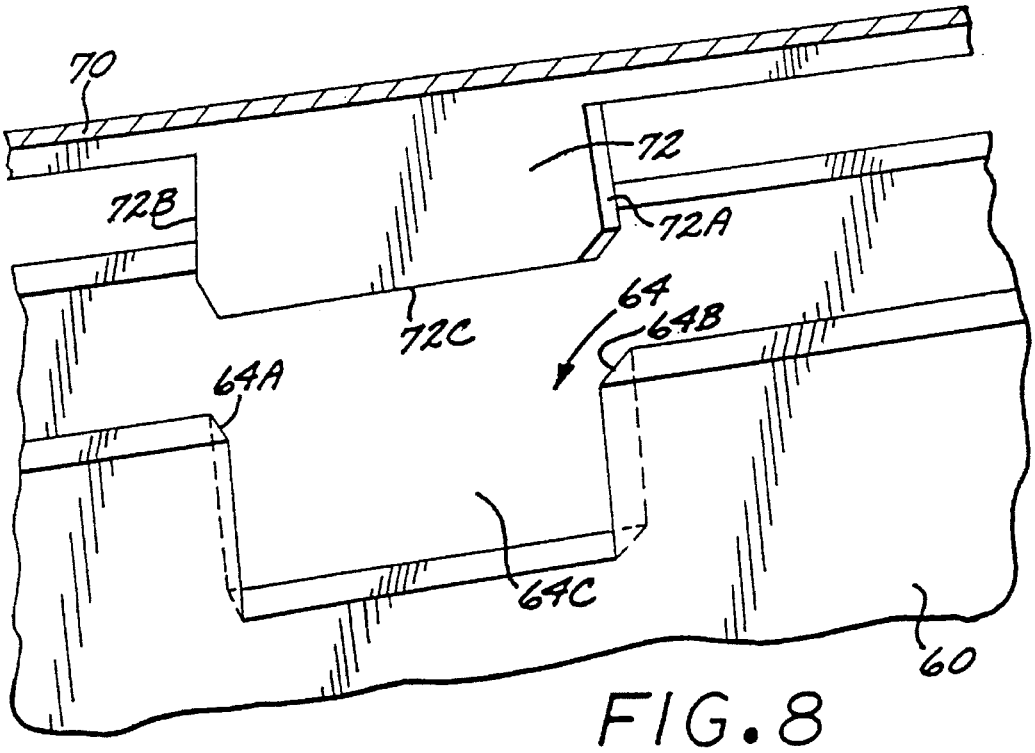
FIG. 8
FIG. 9
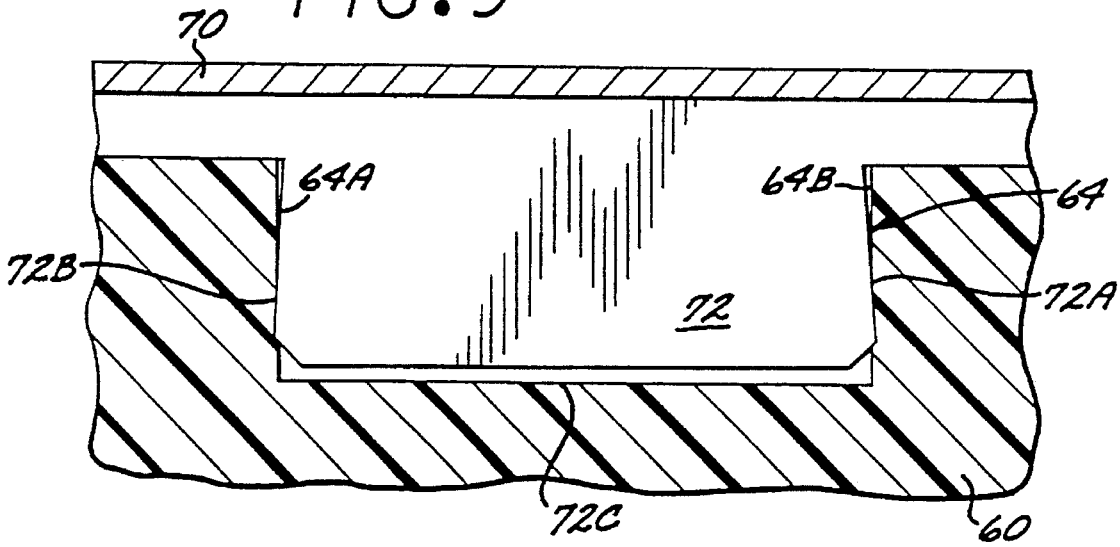

THERMAL INK-JET PEN WITH A PLASTIC/METAL ATTACHMENT FOR THE COVER

RELATED APPLICATIONS

The present invention is related to the following commonly assigned pending U.S. patent applications: COMPACT FLUID COUPLER FOR THERMAL INK JET PRINT CARTRIDGE INK RESERVOIR, Ser. No. 07/853,372, filed Mar. 18, 1992, by James G. Salter et al. U.S. Pat. No. 5,464,578; INK PRESSURE REGULATOR FOR A THERMAL INK-JET PRINTER, Ser. No. 07/928,811, U.S. Pat. No. 5,541,632 filed Aug. 12, 1992, by Tofigh Khodapanah et al.; COLLAPSIBLE INK RESERVOIR STRUCTURE AND PRINTER INK CARTRIDGE, Ser. No. 07/929,615, filed Aug. 12, 1992, by George T. Kaplinsky et al.; TWO MATERIAL FRAME HAVING DISSIMILAR PROPERTIES FOR A THERMAL INK-JET CARTRIDGE, by David S. Swanson et al., Ser. No. 07/994,807, U.S. Pat. No. 5,515,092 filed Dec. 22, 1992; COMBINED FILTER/AIR CHECK VALVE FOR THERMAL INK-JET PEN, by George T. Kaplinsky, Ser. No. 07/995,109, filed Dec. 22, 1992 U.S. Pat. No. 5,426,459; DOUBLE COMPARTMENT INK-JET CARTRIDGE, by David W. Swanson et al., Ser. No. 07/995,221, filed Dec. 22, 1992 abandoned; RIGID LOOP CASE STRUCTURE FOR THERMAL INK-JET PEN, by David W. Swanson et al., Ser. No. 07/994,808, U.S. Pat. No. 5,451,995 filed Dec. 22, 1992; and THIN PEN STRUCTURE FOR THERMAL INK-JET PRINTER, by David W. Swanson et al., Ser. No. 07/994,809, U.S. Pat. No. 5,491,502 filed Dec. 22, 1992; the entire disclosures of which are incorporated herein by this reference.

BACKGROUND OF THE INVENTION

The present invention relates to thermal ink-jet (TIJ) pens, and more particularly to a technique for attachment of a metal cover to the pen. TIJ technology is widely used in computer printers. Very generally, a TIJ includes a print head typically comprising several tiny controllable ink-jets, which are selectively activated to release a jet or spray of ink from an ink reservoir onto the print media (such as paper) in order to create an image or portion of an image. TIJ printers are described, for example, in the Hewlett-Packard Journal, Volume 36, Number 5, May, 1985, and Volume 39, Number 4, August, 1988.

An object of this invention is to provide a TIJ pen which includes an external pen frame structure fabricated of plastic, and a metal cover which is attached to the plastic frame structure to enclose an open region defined by the frame and protect an ink reservoir within the TIJ pen.

A further object is to provide a technique for rigidly attaching a metal cover to a plastic frame without the use of adhesives, screws, thermal, or ultrasonic processes.

SUMMARY OF THE INVENTION

In accordance with this invention, a thermal ink-jet pen comprises an external pen frame structure fabricated of a plastic material and a metal cover attached to the frame structure. The frame structure defines the external periphery of the pen and large open regions at the sides thereof. An ink reservoir is mounted within the frame structure, and a thermal ink-jet printhead is coupled to the ink reservoir. The metal cover comprises a planar surface member for covering the open region defined by the frame. Means are provided for attaching the metal cover to the plastic frame structure, wherein the cover encloses the open region and protects the ink reservoir. Typically, the frame structure defines two large open regions, one on each pen side, and there are two metal covers attached to the frame, one covering each open region.

In accordance with another aspect of the invention, the frame structure comprising a plurality of tab mating features. The metal cover comprises a planar surface and has a plurality of spaced metal tabs projecting from the planar surface for engagement with the mating features of the frame structure.

The tabs are press fit into engagement with the mating features of the frame structure such that the tabs displace plastic on the mating features. As a result, the tabs become locked into the frame features, and thereby secure the cover to the frame structure without adhesives, screws, thermal, or ultrasonic processes.

In accordance with a further aspect of the invention, the tab includes an end portion which is enlarged with respect to the tab body, so that the end portion displaces plastic defining the mating features when the cover is attached.

The mating features comprise a slot formed in the frame, the slot having a width dimension smaller than the enlarged end portion of the tab, wherein as the tab is press fit into the slot, plastic surrounding the slot is displaced. Preferably, the slot further includes beveled sides presenting plastic material at the sides which is displaced as the tab is press fit into the slot.

BRIEF DESCRIPTION OF THE DRAWING

These and other features and advantages of the present invention will become more apparent from the following detailed description of an exemplary embodiment thereof, as illustrated in the accompanying drawings, in which:

FIGS. 1 and 2 are isometric views of a TIJ pen having two metal sidecovers attached in accordance with the present invention.

FIG. 5 is a cross-sectional view taken along the same line as FIG. 4, but showing the cover press fit into engagement with the dovetail slot features in the frame.

FIG. 6 is a cross-sectional view taken along line 6—6 of FIG. 5; FIG. 6A is a similar view but of a cover fully seated in the frame.

FIG. 7 is a cross-sectional view taken along line 7—7 of FIG. 5.

FIGS. 8 and 9 are closeup views of one exemplary locking tab and frame dovetail slot feature, respectively in positions to be engaged, and in engagement with, each other.

DETAILED DESCRIPTION OF THE PREFERRED EMBODIMENT

Figure 3:
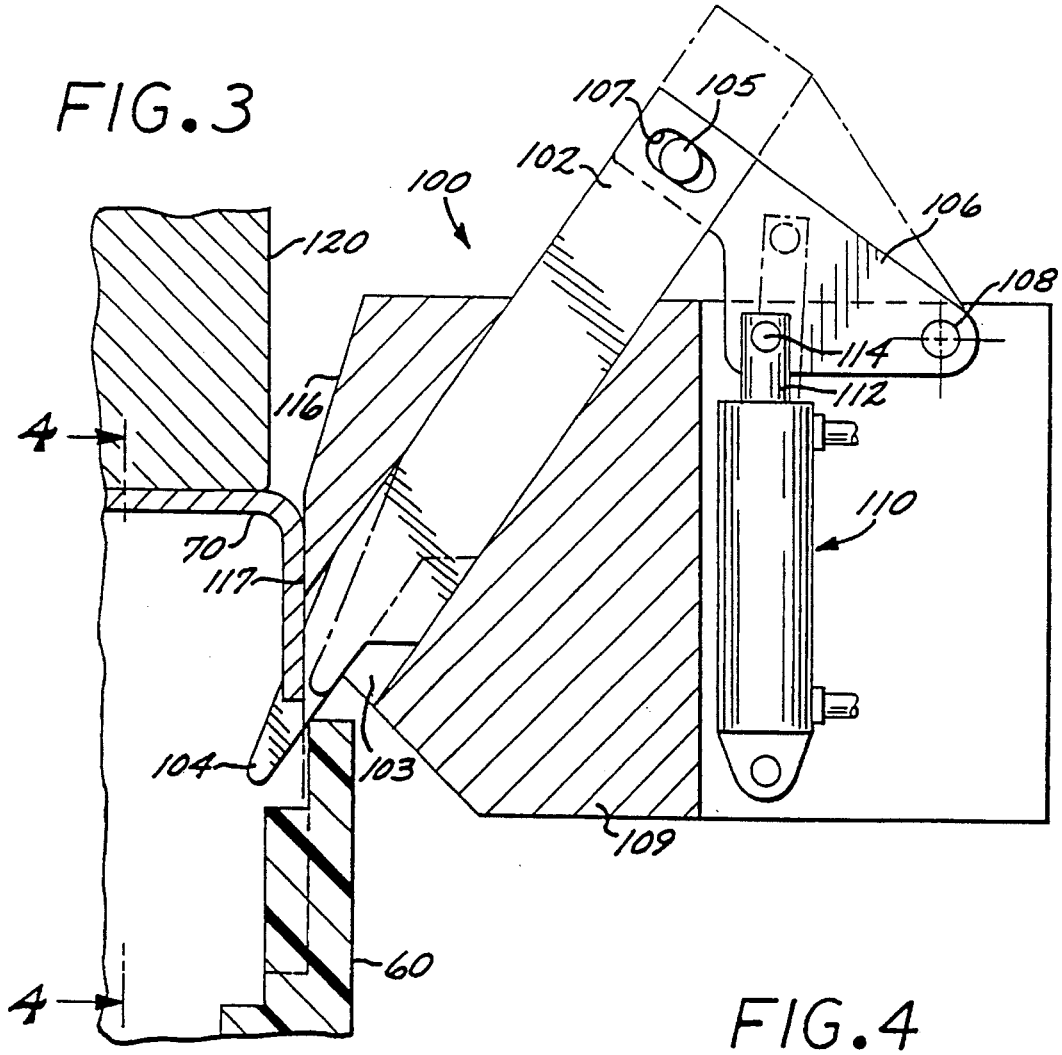
FIG. 3 illustrates a tool used in the attachment of a metal cover to the TIJ pen of FIG. 1.

FIGS. 1–9 illustrate a TIJ pen 50 embodying the invention. The pen comprises an external frame structure 60, and a pair of side covers 70 and 80. The frame 60 defines the external periphery of the pen 50 as a narrow, flat structure. The TIJ pen 50 provides many benefits for the printing system built to utilize it. The pen 50 is narrow reducing the required width of the printer carriage and therefore the total printer width.

The pen 50 includes a simple and efficient ink delivery system, more fully described in the above-reference pending applications, Ser. Nos. 07/928,811 and 07/929,615. Generally, ink is contained within a reservoir formed by two pieces of thin polyethylene bag material 62 bonded to a compatible plastic material on the frame 60. Two pistons and a spring (not shown) inside the bag provide backpressure to prevent ink from drooling out the printhead 52.

The frame 60 is made of two different plastic materials. The first material is an engineering plastic forming the external surfaces and providing structural support. An exemplary plastic suitable for the purpose is polyphenyleneoxide (PPO). The second plastic material provides the fluid path for the ink and is suitable for attachment of the bag material, as described more fully in the above-referenced pending application Ser. No. 07/853,372.

The covers 70 and 80 may be fabricated of any suitable material; in this exemplary embodiment, the covers are fabricate of metal. The thin metal side covers 70 and 80 protect the inside components, add considerable rigidity to the system, and allow for a high degree of volumetric efficiency. The covers 70 and 80 can be fabricated of a pre-processed metal, such as metal having a pre-painted surface or a PVC clad metal to provide an aesthetically complete appearance. The covers 70 and 80 must be rigid to prevent ink from being squeezed out in the event force is applied against the covers, e.g., during handling of the pen. An exemplary material from which the covers 70 and 80 may be fabricated is low carbon steel having a thickness of 0.019 inches.

The metal covers 70 and 80 may be attached to the plastic frame 60 by adhesives or screw fasteners, or by use of thermal or ultrasonic processes. However, in accordance with another aspect of the invention, the problem of attaching a cover to a thin plastic frame is solved by designing a series of metal tabs on the covers that will lock onto mating plastic features on the frame. The tabs displace plastic on the mating features of the frame during assembly, allowing use of a simple mechanical press to assemble the covers to the frame, with no adhesives, screws, thermal or ultrasonic processes. The design of the cover tabs also enables them to lock into the frame; and the addition of chamfered corners on the tab aids assembly by providing a lead-in surface. The resulting cover/frame seam will resist shear, axial and transverse forces that occur in the joint as a result of externally applied loads to the pen. This joint allows for use of cosmetically suitable cover materials (e.g., pre-painted metal, PVC clad metal, or metals having a suitable cosmetic surface).

The cover 70 includes a series of spaced tabs 72 which are designed to mate into corresponding dovetailed slot features 64 defined in the frame 60. The cover 80 is a mirror image of the cover 70, and also includes spaced metal tabs 82 which are designed to mate into corresponding dovetailed slot features (not shown) in an edge of the frame 60 similar to the slots 64. Because the attachment technique for the two covers 70 and 80 is identical, only the attachment of cover 70 will be described in detail.

FIG. 2 shows the cover 70 attached to the frame 60, wherein the cover tabs have been partially press fit into the corresponding slot features 64 of the frame 60. The only assembly step remaining to the cover-frame configuration of FIG. 2 is to apply force to the cover to fully seat the tabs into the slot features.

The frames 60 are preferably fabricated by injection molding. Typically the sides of a frame, before integration with the cover, will be bowed slightly inwardly. Similarly, the tabs 72 of a typical cover 70 after fabrication will not be bent exactly perpendicular to the cover surface, but will instead be bent outwardly to a degree. In order to facilitate the mating of the tabs with the slots, special tooling is employed. This tooling acts to force the top edges of the frame sides outwardly to receive the cover, and forces the tabs into a true perpendicular position relative to the cover surface. As a result, the tabs are properly aligned with the dovetailed slots 64 formed in the frame sides, and force can be applied to press fit the tabs into engagement with the slots. Exemplary tooling to accomplish these functions is shown in FIG. 3.

FIG. 3 illustrates a mechanical press arrangement for press fitting the cover tabs into engagement with the slot features 64 of the frame 60, to result in the partially assembled cover-frame configuration as shown in FIG. 2. A tool 100 includes an arm 102 with an blade tip 104. A dogleg section 106 pivots about pivot point 108. The arm 102 and dogleg section 106 are connected by a pin 105 fixed to the section 106 and extending through a slot 107 formed in the arm 102. The arm 102 in turn rides in a slot 103 defined in tooling block 109.

A double acting pneumatic cylinder 110 has a piston rod 112 which is connected to the intermediate area of the dogleg section at point 114. Actuation of the cylinder 110 then causes extension or retraction of the piston 112, thereby driving the dogleg section 106 to pivot upwardly or downwardly about the pivot point 108, in turn causing the arm 102 to slide upwardly or downwardly within slot 103.

The tool 100 further includes an inclined block surface 116 and a vertical surface 117 which extends along the side of the cover. As the tabs 72 come into contact with these surfaces, those tabs which are splayed outwardly are bent into a perpendicular position relative to the cover surface. In operation, the blade tip 104 is employed to force the inwardly bowed top edge of the frame outwardly into alignment with the cover tabs. A press tool 120 is extended downwardly to contact the top surface of the cover 70, pressing the cover downwardly. At the commencement of the operation, the blade tip 104 is fully extended downwardly. The blade tip 104 is positioned so that it is intermediate two adjacent tabs 72. As the cover is pressed downwardly, the side of the frame 60 engages the blade tip 104, thereby applying pressure tending to bend the side outwardly as the cover is pressed downwardly. In the meantime, the tabs are aligned by engagement with the block surfaces 116 and 117, tending to align the tabs with the recessed features 64 formed in the frame 60. As the cover 70 continues to be pressed downwardly by the press tool 120, the blade tip 104 is withdrawn by actuation of the cylinder 110 to lift the blade tip away from engagement with the frame side, until the blade tip is fully retracted away from the side of the frame. This permits the cover 70 to be press fit into engagement with the frame features by continued downward pressure of the press tool 120.

In this embodiment, the press tool 120 does not apply sufficient force to fully seat the tabs into the slots 64, but rather only partially seats the tabs to the extent shown in FIG. 2. The partially assembled pen is then moved to another station where another press tool, capable of exerting a greater force, is applied to fully seat the tabs into the dovetailed slots. The press fitting of the tabs 72 into the dovetail slots 64 imparts great rigidity to the installed cover.

It will be understood that typically there will be a plurality of blade elements 104 for each side of the cover, disposed between adjacent recessed features of the frame, although a blade element is not required for each tab. Thus, there may be tools 100 disposed along each side of the frame 60, each with multiple blade tip elements. For each tool 100, the blade elements will typically be ganged together for actuation by a single cylinder 110.

In one embodiment employing 14 locking tabs around the periphery of the cover, a press force of about 400 pounds is sufficient to properly attach the cover to the frame.

Figure 4:
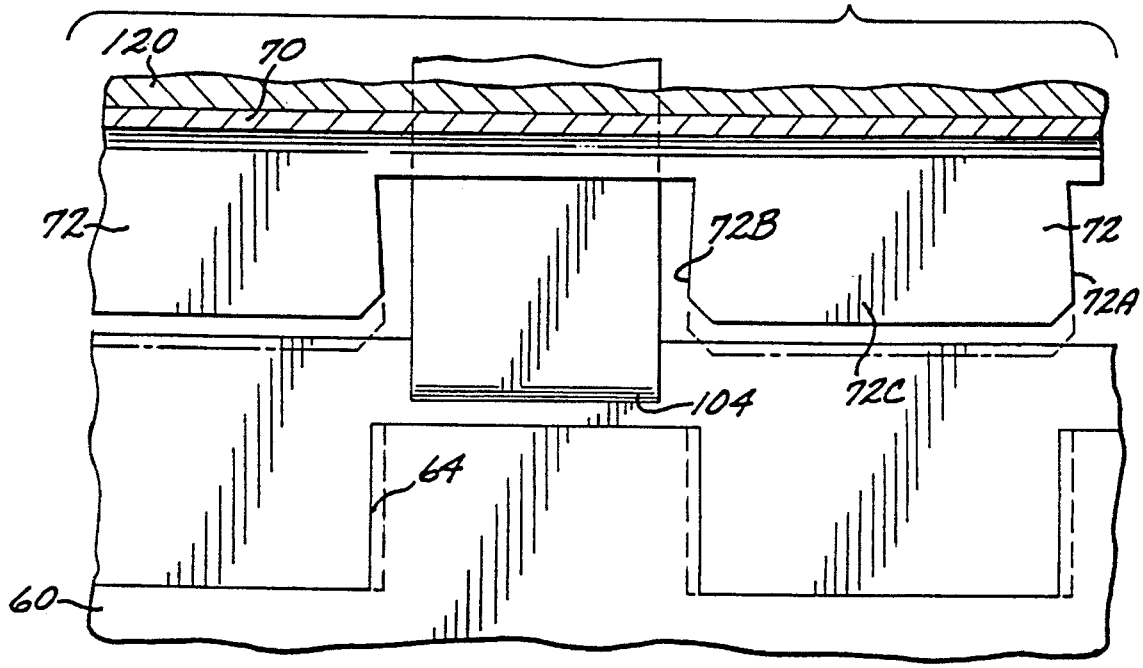
FIG. 4 is a cross-sectional view taken along line 4—4 of FIG. 3.

FIG. 4 shows the position of the blade end 104 as the block 120 begins its downward motion. The blade end is disposed between adjacent recessed features 64 formed in the frame 60.

FIG. 5 is a cross-sectional view taken along the same line as FIG. 4, but with the tabs 72 inserted into the features 64 of the frame 60. FIGS. 6 and 7 illustrate in more detail the manner in which the tabs have been seated into the features 64. FIG. 6 is a cross-section showing the cover which has been partially seated in the frame, as shown in FIGS. 2 and 5. FIG. 6A shows the cover after it has been fully seated, as described above. FIG. 7 shows the beveled side walls 64A, 64B which define the dovetailed slot features. The side walls 64A, 64B form an acute angle with the long wall 64C comprising the feature 64. The tab 72 has a width dimension selected so that plastic material comprising the frame 60 must be displaced by the side edges of the tab 72 in order for the tab to fully seat within the slot feature. The beveling of the side walls 64A, 64B serves to capture the tab within the feature. Moreover, as shown in FIG. 4, the tab side edges 72A and 72B are not exactly perpendicular to the cover, but taper outwardly slightly, so that the tab end region 72C has a width dimension which is larger than the width of the tab adjacent the cover 70. The tab tip also has beveled edges which serve to lead the tab into the feature 64.

FIGS. 8 and 9 illustrate further the manner in which the tab 72 engages the feature 64. FIG. 8 shows the relatively wider width dimension of the tab tip than the width of the feature 64. FIG. 9 shows the tab engaged in the feature, with the side walls displacing plastic material at the edges of the feature 64.

Figure 10:
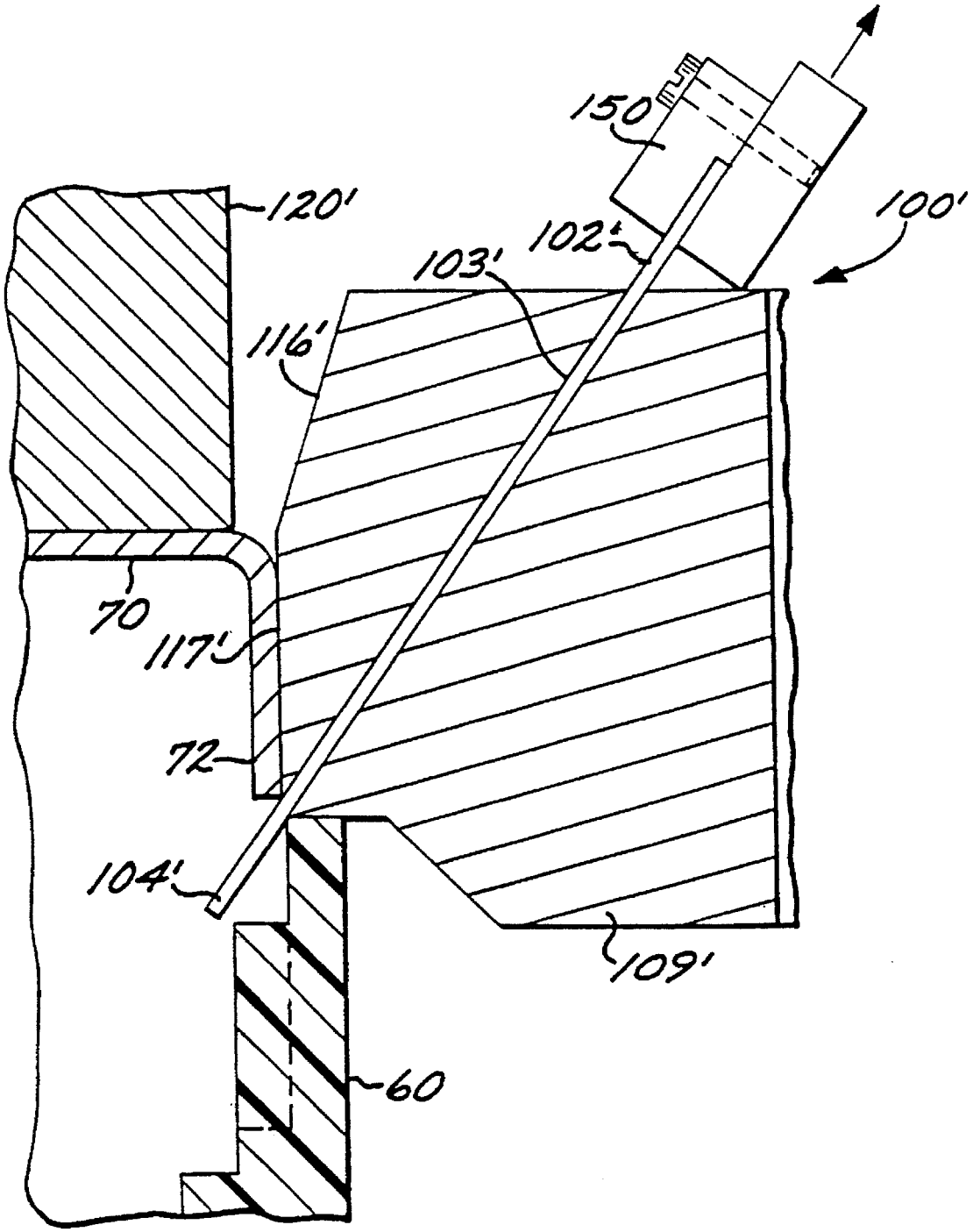
FIG. 10 illustrates an alternate embodiment of tooling which can be used in the attachment of a metal cover to a TIJ pen.

FIG. 10 illustrates an alternate tool 100' which may be employed to assemble the cover 70 to the pen frame 60. In this embodiment, the blade 102 has been replaced by a much thinner blade 102' which slidably fits into a narrow groove 103' formed in the tooling block 109'. The blade 102' is formed of a flexible high strength steel, much like the blades of a feeler gauge. The outer end of the blade 102' is connected to a connector block 150, which is connected to a drive element (not shown) which selectively pushes the blade down or pulls it away from the interface between the cover and the frame. In all other respects, the tool 100' operates in the same manner as the tool 100 (FIG. 3). The blade 102' forces the inwardly bowed top edge of the frame to an upright position, while the shoulder 116' forces the tabs 72 to the perpendicular position as shown.

Figure 11A:
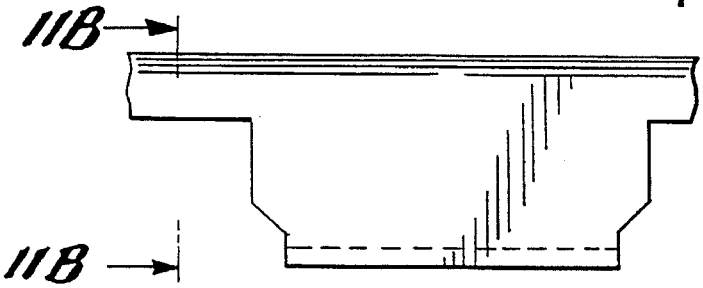
FIGS. 11A, 11B and 12–15 illustrate various configurations of the locking tabs extending from the cover to attach the cover to the TIJ pen.
Figure 11B:
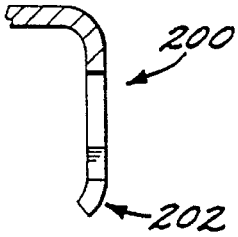
Figure 12:
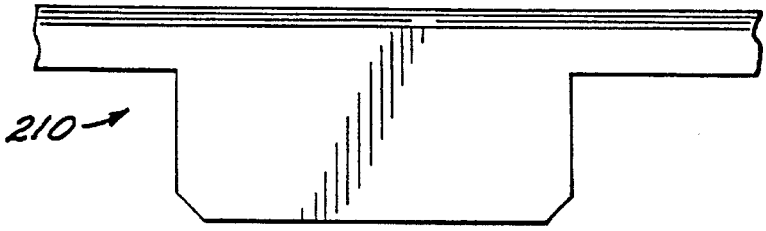
Figure 13:
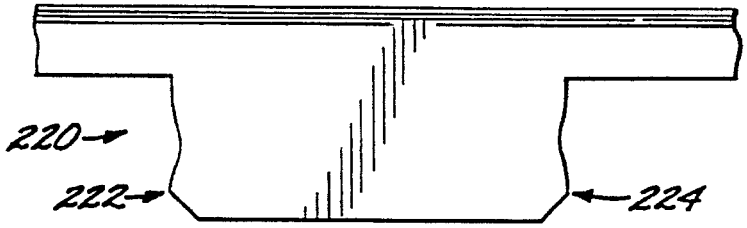
Figure 14:
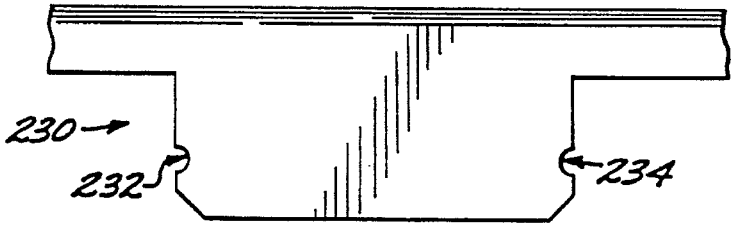
Figure 15:
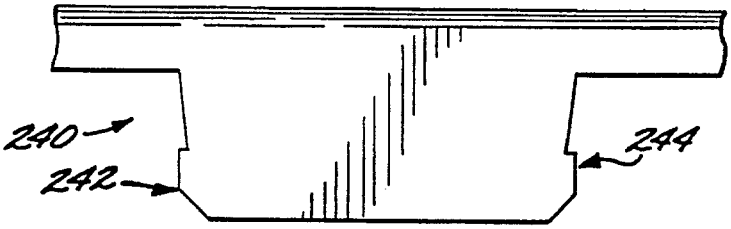

FIGS. 11A, 11B and 12–15 illustrate various alternative configurations of the tabs 72. FIGS. 11A and 11B illustrate a tab 200 wherein the tap tip 202 is curved with a lead-in radius to facilitate the mating of the tab with the feature formed in the frame. The tip of the tab 200 is reduced in width as well. FIG. 12 shows a tab 210 wherein the sides are parallel to each other, and perpendicular to the cover. FIG. 13 shows a tab 220 wherein the tab sides initially taper inwardly toward the tip, and taper outwardly to form a pointed bulged portions 222 and 224 adjacent each tip side. FIG. 14 shows a tab 230 employing half-circular cutouts 232 and 234 adjacent the tab tip. FIG. 15 shows a tab 240 wherein hook elements 242 and 244 are defined in each tab side to engage the frame feature.

The technique of this invention for attaching a cover to the plastic frame of a TIJ requires a minimum of plastic on the frame yet imparts a high degree of structural integrity to the pen. Another advantage is that the cover may be attached to the frame using a simple mechanical press, and without the use of adhesives, screws, thermal, or ultrasonic processes. The cover tab mating features in the plastic frame can be formed using strong features in the mold consistent with efficiently established parting planes.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An ink-jet pen comprising:

an external pen frame structure fabricated of a plastic material, said frame structure having formed therein a plurality of tab mating features defined by said plastic material, said plastic material defining said tab mating features being displaceable, and wherein said frame structure comprises a plurality of upright side members, and said mating features comprise a plurality of slots defined in said upright side members and extending along said side members;

a cover for attachment to said frame structure, said cover having a plurality of spaced projecting metal tabs for engagement with said mating features of said frame structure;

wherein said tabs are press fit into engagement with said mating features of said frame structure such that said tabs become locked into said frame features, and thereby secure said cover onto said frame structure.

2. The pen of claim 1 wherein at least one of said tabs includes an end portion which is enlarged with respect to a body portion of said at least one of said tabs, said end portion displacing plastic on a corresponding one of said mating features.

3. The pen of claim 2 wherein said tab end portion further includes chamfered corners to assist in engagement of said at least one of said tabs with a corresponding one of said tab mating features.

4. The pen of claim 1 wherein said mating features each comprises a slot formed in said frame, said slot having a width dimension smaller than a corresponding width dimension of said tabs, wherein as a corresponding one of said tabs is press fit into said slot, plastic surrounding said slot is displaced.

5. The pen of claim 4 wherein said slot further includes beveled sides presenting plastic material at said sides which is displaced as said corresponding one of said tabs is press fit into said slot.

6. The pen of claim 1 wherein each of said tabs comprises a tab tip curved inwardly to define a lead-in radius to facilitate engagement of said tabs with said mating features of said frame structure.

7. The pen of claim 1 wherein said cover comprises a substantially planar cover surface, said tabs extend substantially perpendicular to said surface when press fit into engagement with said mating features.

8. A method for attaching a cover to an ink-jet pen frame structure, comprising a sequence of the following steps:

providing an external pen frame structure fabricated of a plastic material, said frame structure comprising a plurality of upright side members, said frame structure having formed therein a plurality of tab mating features defined by said plastic material, said plastic material defining said tab mating features being displaceable, and wherein said mating features include a plurality of slots defined in said upright side members and extending along said side members;

aligning said cover with said frame structure, said cover having a plurality of spaced metal tabs projecting from said surface for engagement with said mating features of said frame structure;

forcing said cover and frame structure together to press fit said tabs into engagement with said mating features of said frame structure such that said tabs become locked into said mating features, and thereby secure said cover onto said frame structure.

9. The method of claim 8 wherein at least one of said tabs includes an end portion which is enlarged with respect to a body portion of said at least one of said tabs, said end portion displacing plastic on a corresponding one of said mating features.

10. The method of claim 9 wherein said tab end portion further includes chamfered corners to assist in engagement of said at least one of said tabs with a corresponding one of said mating features.

11. The method of claim 8 wherein said mating features comprise a slot formed in said frame, said slot having a width dimension smaller than a corresponding width dimension of said tabs, wherein as a corresponding tab is press fit into said slot, plastic surrounding said slot is displaced.

12. The method of claim 11 wherein said slot further includes beveled sides presenting plastic material at said sides which is displaced as said corresponding tab is press fit into said slot.

13. The method of claim 8 wherein said tabs comprise a tab tip curved inwardly to define a lead-in radius to facilitate engagement of said tabs with said mating features of said frame structure.

14. The method of claim 8 wherein said step of aligning said cover with said frame structure include positioning said cover between tool blade members at areas between adjacent tabs so that said cover is positioned just above said frame structure with said tabs aligned with corresponding ones of said mating features.

15. The method of claim 8 wherein said step of forcing said cover and said frame structure together includes deploying a pressing tool to press said cover into engagement with said frame structure.

16. The method of claim 8 wherein said cover comprises a substantially planar cover surface, said tabs extend substantially perpendicular to said surface when press fit into engagement with said mating features.

17. The method of claim 8 wherein said step of aligning said cover with said frame structure includes placing said cover in a tool including an inclined block surface transitioning to a surface aligned with a side of said frame structure, and pushing said cover toward said frame structure to bend tabs which are splayed outwardly into a perpendicular position relative to a cover surface.

18. An ink-jet pen comprising:

an external pen frame structure fabricated of a plastic material, said frame structure defining an external periphery of said pen and surrounding an open region;

an ink reservoir mounted within said frame structure;

an ink-jet printhead coupled to said ink reservoir; and a cover for covering said open region; and metal means for attaching said cover to said plastic frame structure, wherein said cover encloses said open region to protect said ink reservoir, wherein said attaching means secures only edges of said cover to said frame structure and inhibits flexing of said cover after attachment of said cover to said frame structure, thereby tending to prevent said cover from being deflected and thereby reducing a volume enclosed by said frame structure and said cover and available to said ink reservoir.

19. The pen of claim 18 wherein said attaching means comprises a plurality of metal tabs projecting from an edge of said cover and a corresponding plurality of tab receptacles formed in said plastic frame, said tabs being received in said receptacles to form a tab-to-receptacle connection.

20. The pen of claim 18 wherein said attaching means comprises:

a plurality of tab mating features formed in said frame structure adjacent said open region;

a plurality of spaced metal tabs projecting from said surface of said cover, wherein said tabs of said cover are press fit into engagement with corresponding mating features formed adjacent said open region such that said tabs displace plastic on said mating features, and thereby secure said cover to said frame structure.

21. The pen of claim 20 wherein each of said respective tabs include an end portion which is enlarged with respect to a body portion thereof, said end portion displacing plastic on said mating features.

22. The pen of claim 21 wherein said tab end portion further includes chamfered corners to assist in engagement of said tabs with said mating features.

23. The pen of claim 20 wherein said mating features comprise a slot formed in said frame, said slot having a width dimension smaller than a corresponding width dimension of a corresponding one of said tabs, wherein as said corresponding one of said tabs is press fit into said slot, plastic surrounding said slot is displaced.

24. The pen of claim 23 wherein said slot further includes beveled sides presenting plastic material at said sides which is displaced as said corresponding one of said tabs is press fit into said slot.

25. The pen of claim 20 wherein said tabs comprise a tab tip curved inwardly to define a lead-in radius to facilitate engagement of said tabs with said mating features of said frame structure.

26. The pen of claim 20 wherein said frame structure comprises a peripheral upright pen side member, and wherein said mating features comprise a plurality of slots defined in said upright side member and extending along said side member.

27. The ink-jet pen of claim 18, further comprising a printing system for using said pen, said printing system comprising a printer carriage for holding said pen, and a carriage scanning apparatus for moving said printer carriage along a carriage scan axis.

28. The ink-jet pen of claim 27 wherein said printer carriage further comprises means for holding a plurality of said ink-jet pens, and said printing system includes a plurality of said ink-jet pens.

29. The ink-jet pen of claim 27 wherein said printing system includes a media path through which a print medium is advanced through a print zone, said carriage scan axis is transverse to said media path at the print zone, and said printing system further includes a media advancing apparatus for incrementally advancing the print medium to the print zone for swath printing by said ink-jet pen.

30. An ink-jet pen comprising:

an external pen frame structure fabricated of a plastic material, said frame structure defining an external periphery of said pen, said frame structure surrounding first and second opposed side open regions;

an ink reservoir mounted within said frame structure;

an ink-jet printhead coupled to said ink reservoir; and first and second cover members for attachment to said frame structure, said cover members for covering said open regions; and metal means for attaching said cover members to said plastic frame structure, wherein said cover members enclose said open regions to protect said ink reservoir, wherein said metal attaching means secures only edges of said respective covers to said frame structure and tends to prevent flexing of said cover members after attachment to said frame structure, thereby tending to prevent said cover members from being deflected and thereby reducing a volume enclosed by said frame structure and said cover members and available to said ink reservoir.

31. The pen of claim 27 wherein said attaching means comprises a plurality of metal tabs projecting from the edge of said covers and a corresponding plurality of tab receptacles formed in said plastic frame, said tabs being received in said receptacles to form a tab-to-receptacle connection.

32. The pen of claim 27 wherein said attaching means comprises:

a plurality of tab mating features formed in said frame structure adjacent said first and second open regions;

a plurality of spaced metal tabs projecting from said surface of each of said first and second cover members, wherein said tabs of the respective covers are press fit into engagement with corresponding mating features formed adjacent said first and second open regions such that said tabs displace plastic on said mating features, and thereby secure said covers to said frame structure.

33. The pen of claim 32 wherein said respective tabs include an end portion which is enlarged with respect to a tab body portion, said end portion displacing plastic on said mating features.

34. The pen of claim 33 wherein said tab end portion further includes chamfered corners to assist in engagement of said tabs with said mating features.

35. The pen of claim 32 wherein said mating features comprise a slot formed in said frame, said slot having a width dimension smaller than a corresponding width dimension of a corresponding tab, wherein as said corresponding tab is press fit into said slot, plastic surrounding said slot is displaced.

36. The pen of claim 35 wherein said slot further includes beveled sides presenting plastic material at said sides which is displaced as said corresponding tab is press fit into said slot.

37. The pen of claim 32 wherein said tabs comprise a tab tip curved inwardly to define a lead-in radius to facilitate engagement of said tabs with said mating features of said frame structure.

38. The pen of claim 32 wherein said frame structure comprises a peripheral upright pen side member, and wherein said mating features comprise a plurality of slots defined in said upright side member and extending along said side member.

39. The ink-jet pen of claim 30, further comprising a printing system for using said pen, said printing system comprising a printer carriage for holding said pen, and a carriage scanning apparatus for moving said printer carriage along a carriage scan axis.

40. The ink-jet pen of claim 39 wherein said printer carriage further comprises means for holding a plurality of said ink-jet pens, and said printing system includes a plurality of said ink-jet pens.

41. The ink-jet pen of claim 39 wherein said printing system includes a media path through which a print medium is advanced through a print zone, said carriage scan axis is transverse to said media path at the print zone, and said printing system further includes a media advancing apparatus for incrementally advancing the print medium to the print zone for swath printing by said ink-jet pen.

* * * * *